United States Patent [19]

Sharp

[11] Patent Number: 4,494,350

[45] Date of Patent: Jan. 22, 1985

[54] ALUMINUM SUSPENSION SYSTEM

[75] Inventor: Joseph F. Sharp, Norwalk, Calif.

[73] Assignee: Ceiling Dynamics, Inc., Tucson, Ariz.

[21] Appl. No.: 420,354

[22] Filed: Sep. 20, 1982

[51] Int. Cl.[3] ..... E04C 2/42; F16B 7/22

[52] U.S. Cl. ..... 52/665; 52/484; 403/347

[58] Field of Search ..... 52/664, 665, 666, 667, 52/668, 669, 484; 403/347, 346, 252

[56] References Cited

U.S. PATENT DOCUMENTS

| | | | |
|---|---|---|---|
| 3,093,221 | 6/1963 | Purdy | 52/665 |
| 3,321,879 | 5/1967 | Purdy | 52/665 X |
| 3,565,474 | 2/1971 | Stumbo | 403/252 X |
| 3,778,947 | 12/1973 | Sauer | 52/664 X |
| 4,108,563 | 8/1978 | Brown | 52/667 X |
| 4,314,432 | 2/1982 | Rosenbaum | 52/667 X |
| 4,317,641 | 3/1982 | Sauer | 52/667 X |
| 4,389,828 | 6/1983 | Cary | 52/665 |

*Primary Examiner*—John E. Murtagh
*Assistant Examiner*—Kathryn L. Ford
*Attorney, Agent, or Firm*—Eugene Chovanes

[57] ABSTRACT

A separate connector piece for use in constructing a suspended ceiling grid system is provided. The grid system is of the type consisting of a series of parallel longitudinal beams interconnected with a series of perpendicular cross runners. The connector piece is selectively attached to the ends of the cross runners, and forms the interconnections when the cross runners are aligned on opposite sides of a longitudinal beam. The connector pieces of the opposing cross runners extend through a slot located in the longitudinal beam and may be attached to the opposing cross runner, thus forming the interconnection.

9 Claims, 7 Drawing Figures

ALUMINUM SUSPENSION SYSTEM

BACKGROUND OF THE INVENTION

1. Field of the Invention

The present invention relates to a suspended ceiling system and more particularly to a connector means for connecting cross-runner members to main runner members in a suspended ceiling grid system for acoustical tile or the like.

2. Description of the Prior Art

Suspended ceiling systems are extensively used throughout the construction industry, both in new building construction and in the renovation of older buildings. This type of ceiling consists of a grid-like supporting base which is suspended from the true ceiling and which supports a layer of ceiling panels, typically acoustical tile. This suspended grid also oftentimes serves as a support base for lighting fixtures and heating and air conditioning outlet ducts.

The grid itself is formed by two sets of beams joined together, the "main runners" and the "cross runners". The main runners consist of long beam segments, parallel to one another, each typically extending across the length of the ceiling. Where this distance is longer than the individual length of a beam segment, a number of such segments are spliced together to create one continuous longitudinal beam. In contrast, the cross runners, while also parallel to one another, form discontinuous beams which typically span only the distance between the main runners. The grid system is suspended from the true ceiling using wires or other similar means attached to the man runners.

Several different systems for the attachment of the cross runners to the main runners are known to the art. They can generally be divided into two groups: the unitary connectors and the separate or piece connectors. Unitary connectors have the connector pieces integrally formed as part of the cross runner. Such a construction is shown in U.S. Pat. No. 3,979,874 to Cubbler, Jr., et al. The end portions of the cross runners are provided with vertical tabs which are inserted into slots formed in the web portion of the main runners. U.S. Pat. Nos. 3,565,474 to Stumbo, et al., and 4,161,856 to Brown, et al., are similar, with both providing tongues which project from the ends of the cross members. In Stumbo, et al., the tongue is integrally formed with the beam webbing, while Brown, et al., provides rivets for the attachment of the tongue portion.

A variety of separate connector pieces are also disclosed in the prior art. U.S. Pat. No. 3,385,021 to Nys provides a connecting plate that is received by grooves in the cross member flanges (top and bottom). The plate is provided with a projecting member which is received by a slot in the main runner. U.S. Pat. No. 3,093,221 to Purdy provides a connecting plate that clips to the cross runner and a spring nose that enters a hole in the main runner. U.S. Pat. No. 3,677,589 to Roles provides an installation clip which connects with the cross member using mating slots, and connects with the main runner utilizing a concave engaging portion. Finally, U.S. Pat. No. 3,596,425 to Kodaras provides a clip member which is received by slots in a specially designed main runner. The clip member then attaches to two cross runners using locking tabs.

The great utility, and in fact, popularity, of these ceiling grid suspension systems is directly related to the ease of their on-site installation. In commercial sidings particularly, not only is the facility of installation important, but much consideration is also given to the adaptability of the system to differing ceiling constructions and the amount of time required for installation.

Often in the prior art, the simplest and quickest connections were provided by the integral connectors. These, however, have a drawback that they are more expensive to manufacture. The separate connector assemblies, while less expensive to manufacture, often had the problem of poor mechanical connections. Unless locking tabs or other bendable connectors were used, looseness often existed in the connection.

SUMMARY OF THE INVENTION

The present invention has as an underlying objective the improvement in the heretofore-known types of ceiling grid connectors by the provision of a new, snap-together system utilizing separate connectors. These connectors attach themselves to the cross runners and then thereafter form the connection. Both the attachment to the cross runner and the formation of the connection may be accomplished without requiring tools or mechanical bending operations.

This goal is inventably achieved by providing a connection formed by the engagement of two tongue plates, each of which is connected to a separate cross runner beam. The tongue plates are connected to their respective cross runners without the use of screws, rivets, or the like, by providing grooves in the upper and lower flanges of the cross runners which slidably receive the tongue plate and hold the plate against the web portion of the cross runner. Longitudinal movement of the cross runner is restrained by providing raised dimples on the tongue plate which snap into an opening located in the web of the cross runner.

The prior art utilized tangs, which are received in suitable apertures in the cross runner. However, to permit a slidable mounting, it was necessary that the tang bend inwardly, thus permitting the connector plate to slide adjacent to the cross runner web. This flimsiness of the tang frequently resulted in the tang buckling when the connector was subjected to compressive loading. Applicant's invention makes this much less likely to occur as the dimple is structurally more rigid in the longitudinal direction than the tang. The dimple is also more rigid in lateral direction, so rather than the dimple deforming during mounting on the cross runner, the tongue plate bends outwardly from the cross runner web, permitting the dimple to slide along the web. The dimple provides a connection which is significantly more resistant to buckling failure than the prior art connection, and the lateral weakness of the tongue plate is of no consequence because after mounting, no lateral load is applied.

The tongue plate is now securely attached to an end of the cross runner, with the tongue portion of the plate projecting beyond the end of the cross runner.

The projecting tongues are utilized in the formation of the connections with the main runners. Unlike the majority of prior art, the connection is actually formed with another cross runner located on the opposite side of the main runner rather than with the main runner itself. In effect, the main runner is sandwiched between the connected ends of two cross runners, located opposite one another on either side of the main runner.

The projecting tongue plates of the opposing cross runners are inserted in a vertical slot of the webbing of the main runner. Each tongue plate has an opening formed therein, which ultimately receives a tab which is formed in the webbing at the end of the cross runner to be joined. Upon the insertion of each tongue plate into the vertical slot, the web and openings of opposite cross runners are adjacent one another. The cross runners are then connected together, with the main runner now located in between.

Each tongue plate is also provided with a second dimple. Upon insertion of the tongue plate into the vertical slot, the second dimples for each cross runner lie within the vertical slot and adjacent one another. As together the dimples are wider than the slot, they act so as to occupy the entire vertical slot, preventing sloppiness of fit and vibrational problems.

The inventive connection offers numerous improvements and advantages over the prior art. It is first a separate connector system so it possesses the advantages of shipping, manufacturing, and assembling associated with separate connectors. Additionally, unlike many or most of the previous separate connector systems, no tools or mechanical bending operations are required for assembly. The connector piece slides onto the cross runner and snaps into place. The connection with the second cross member is also effected by a sliding, snap-in type connection.

A comparison between the present invention and the prior art will also demonstrate a considerable structural simplification. The modifications made in the cross runner and in the connector piece itself (the tongue plate) show the utilization of easily machined tabs, holes and dimples, to replace the earlier required attaching means, i.e., rivets, screws, and the like.

An additional feature of the present invention is the increased structural integrity of the ceiling grid system. Rather than having each of the cross runners individually attached to the main runners, the present invention provides for the attachment of the cross runners to one another. The series of cross runners thus acts similarly to a single beam, resulting in increased structural integrity for the overall grid system.

Various other objects, advantages, and features of the present invention will become readily apparent from the ensuing detailed description, and the novel features will be particularly pointed out in the appended claims.

BRIEF DESCRIPTION OF THE DRAWINGS

FIG. 1 is a partial perspective view showing a suspended ceiling grid system for supporting ceiling panels or the like;

DESCRIPTION OF THE PREFERRED EMBODIMENT

Figure 1:
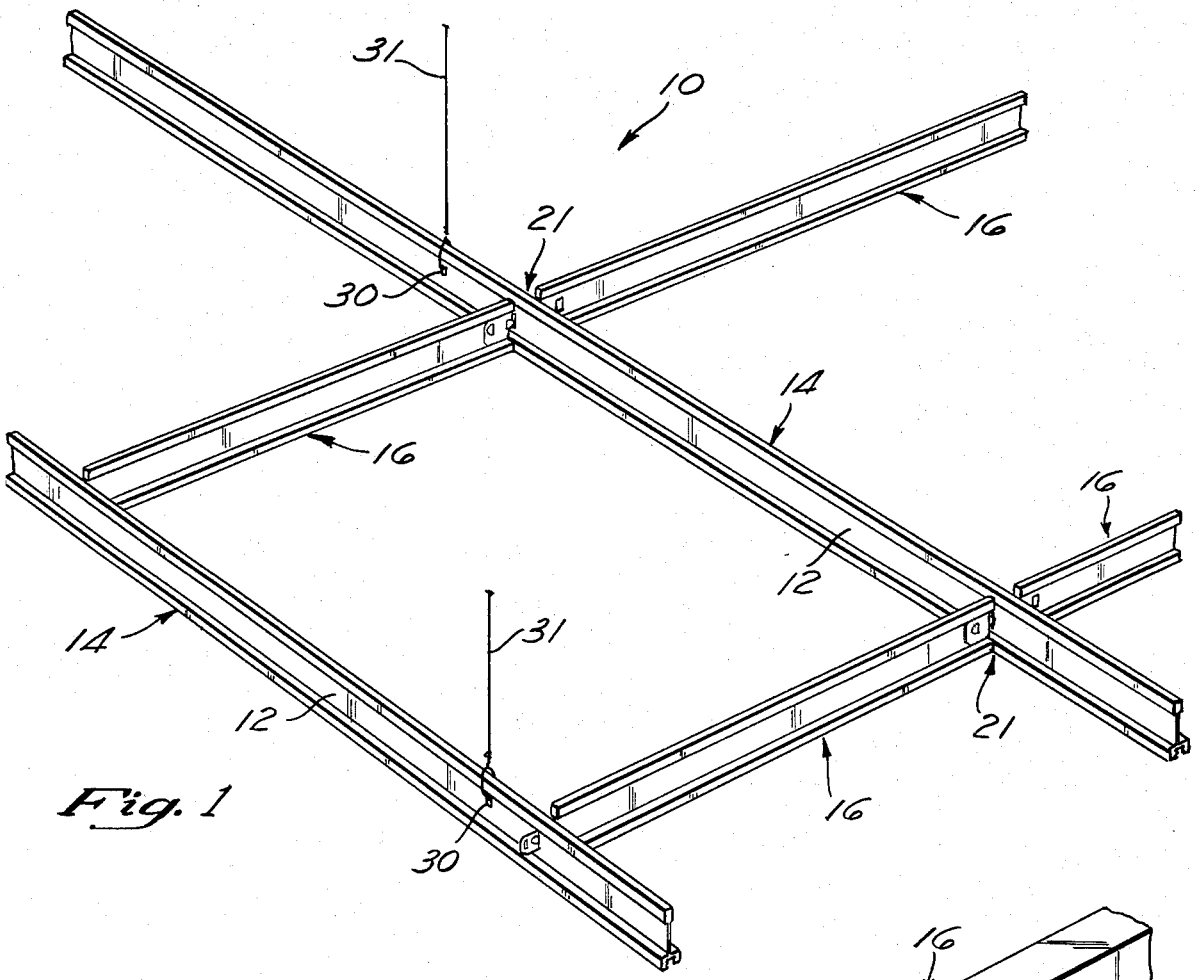

FIG. 1 shows a portion of a suspended grid system 10 for supporting ceiling panels (not shown). The grid system 10 includes a plurality of longitudinal beams 12, in a spaced, parallel relationship. Each longitudinal beam 12 comprises one or more main runners 14, connected in end-to-end relationship and spliced together (not shown). A plurality of cross runners 16 are positioned in parallel, spaced arrangement, normal to the adjacent longitudinal beam 12, and forming interconnections 21 therewith. Thus, the cross runner 16 and the main runners 14 (which form the longitudinal beams 12), cooperate and form the grid system 10.

As shown schematically in FIG. 1, the grid 10 is suspended, either from a true ceiling or from some other overhead structure (not shown). Apertures 30 are formed in the longitudinal beams 12 to permit suspension by a plurality of wire hangers 31. There are, of course, other methods for suspending grid systems 10.

Hereinafter, the suffixes "a" and "b" will be appended to the reference numerals in order to designate the various corresponding portions on the pairs of cross runners shown in FIGS. 3–6. For example, the cross runners of FIGS. 3–6 will be referred to generally as 16 and individually as **16*a* and 16*b*. The same convention will be followed for the component parts and portions comprising cross runners 16 and interconnections 21. In addition, when the terms "vertical" and "horizontal" are used hereinafter in reference to the cross runners 16 and main runners 14, it will be assumed that the runners 14, 16 are lying in a common, horizontal plane, as they are when assembled in grid system 10**.

Figure 3:
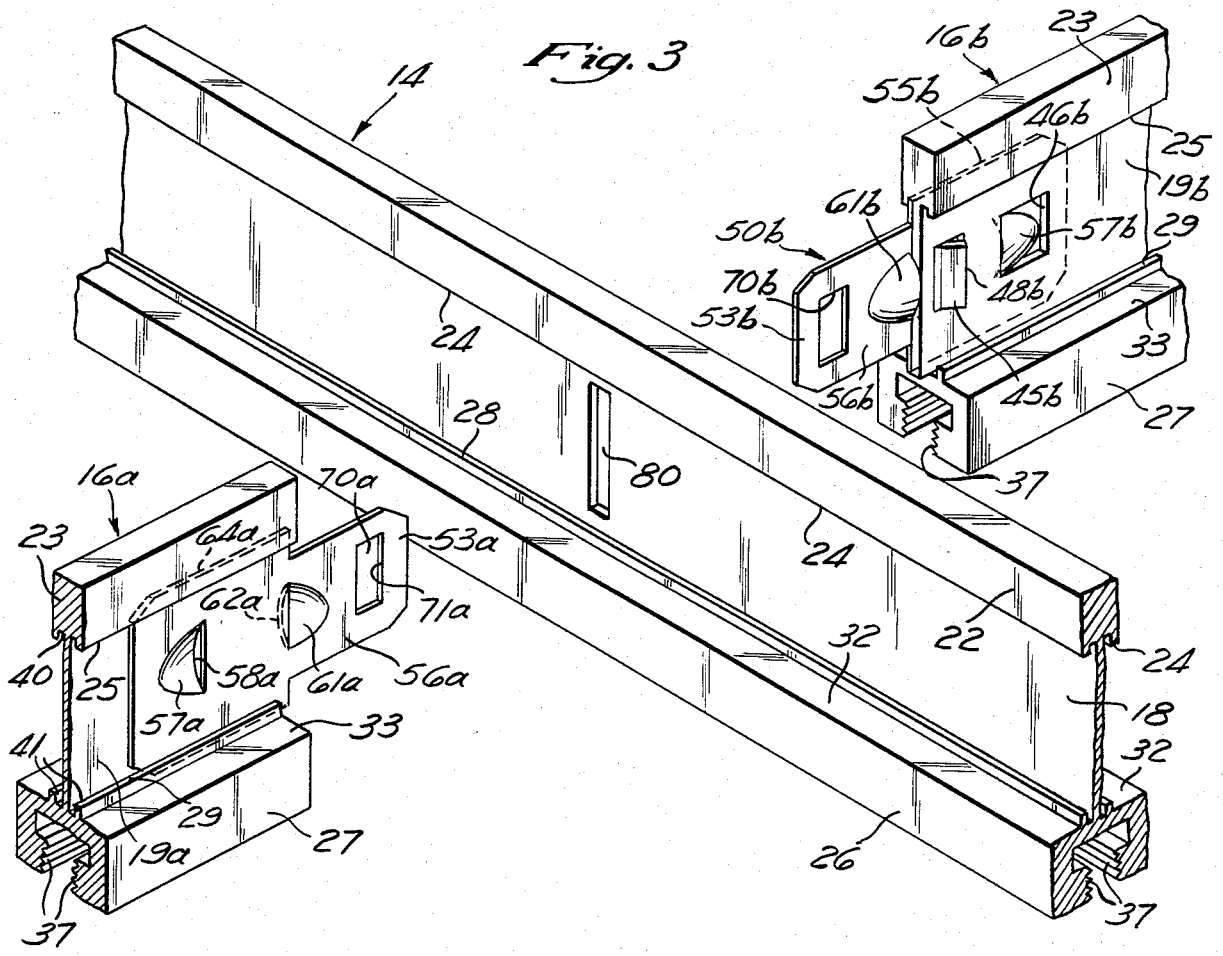
FIG. 3 is a partial perspective view showing a portion of two cross runners, tongue plates in place, located opposite one another and adjacent to a vertical slot in the webbing of a main runner, a portion of which runner is located therebetween.

Referring to FIG. 3, each of the main runners 14 and cross runners 16 include intermediate, elongated web portions 18, 19, respectively, having longitudinally extending box portions 22, 23, respectively, formed along upper edges 24, 25, respectively, thereof, and longitudinally extending panel support flange portions 26, 27, respectively, formed along, and co-extensive with, lower edges 28, 29, respectively, thereof.

The flange portions 26, 27 have upper panel support surfaces 32, 33, respectively, projecting perpendicularly from the webbed portions 18, 19, respectively, for supporting ceiling panels.

Figure 6:
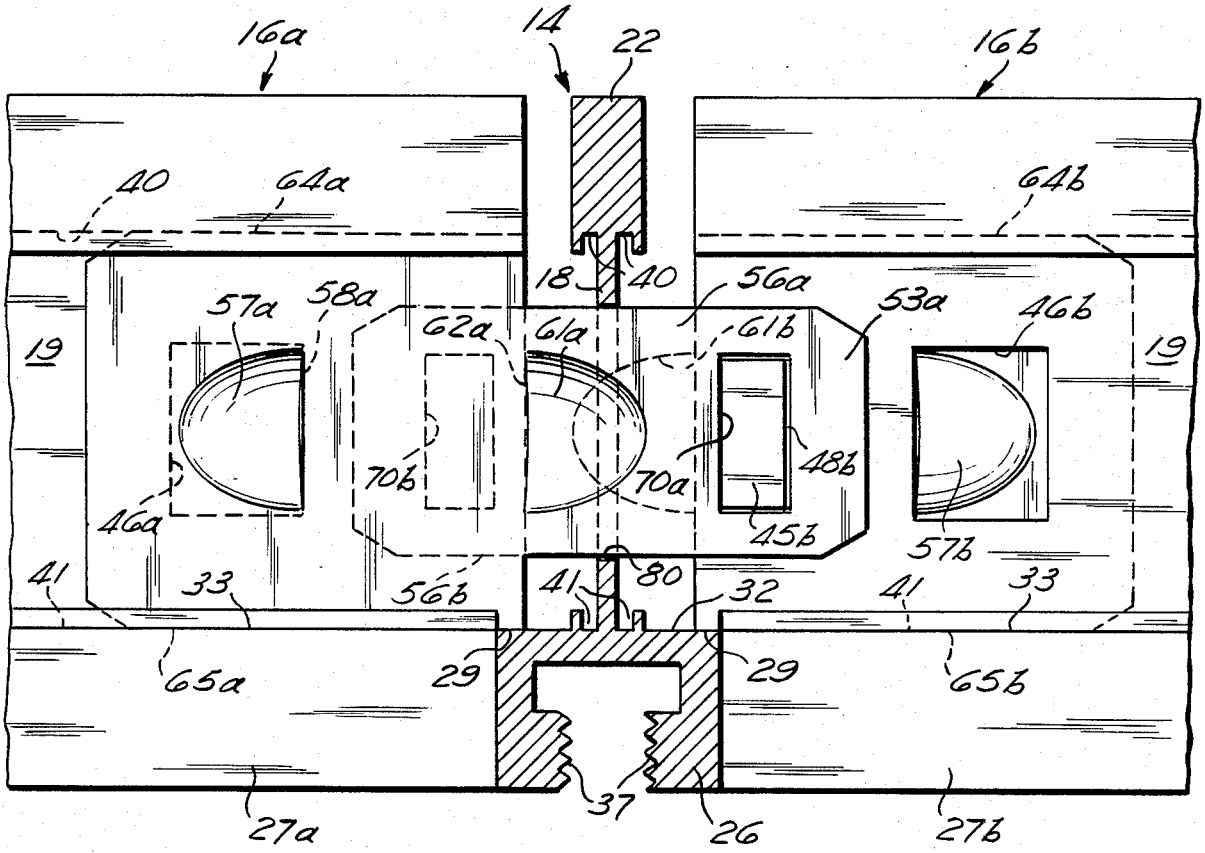
FIG. 6 is a partial, side elevational view, partially in section, showing a connection between two cross runners, with the main runner shown in section and located therebeween, according to the present invention.

As can best be seen in FIG. 6, the flange portions 27 are slightly recessed from an imaginary line formed by the terminus of the box portion 23 and the web 19. This causes the web 19 to project slightly beyond the flange portion 27 and permits the projecting portion of the web 19 to bear flush against the upper surface 32 of the flange portion 26 of the main runner 14. Further, as the lower edge 29 of web the 12 is flush with the surfaces 32, 33 of both panel support flanges 26, 27, respectively, and bridges the abutment between them (FIG. 6), the panel support surfaces 32, 33 will lie in the same plane throughout their length (see FIG. 4).

The flange portions 26, 27 may have, as is shown in the figures, a threaded C-shape, having a threaded opening 37 opposite its point of connection with the web portions 18, 19. However, it will be understood that the flange portions 26, 27, as well as the box portions 22, 23, may have other shapes. For example, it is common for the flange portions to comprise flat members which cooperate with the web portions to form an inverted "T", or for such flange portions to be merely "C"-shaped. In any case, the cross-section of the cross runner 16 is preferably identical with the cross section of the main runners 14 to reduce inventory and tooling requirements. Further, the main and cross runners 14, 16, are preferrably uniform in cross section, and have their respective upper edges 24, 25, parallel to their respective lower edges 28, 29, throughout their length, for ease of manufacture. Moreover, the flange portions 26, 27 are preferrably straight throughout their length, without jogs or bends, also for ease of manufacture. The runners 14, 16 may be produced by any one of a variety of processes, such as extrusion or forming from sheet stock.

Figure 2:
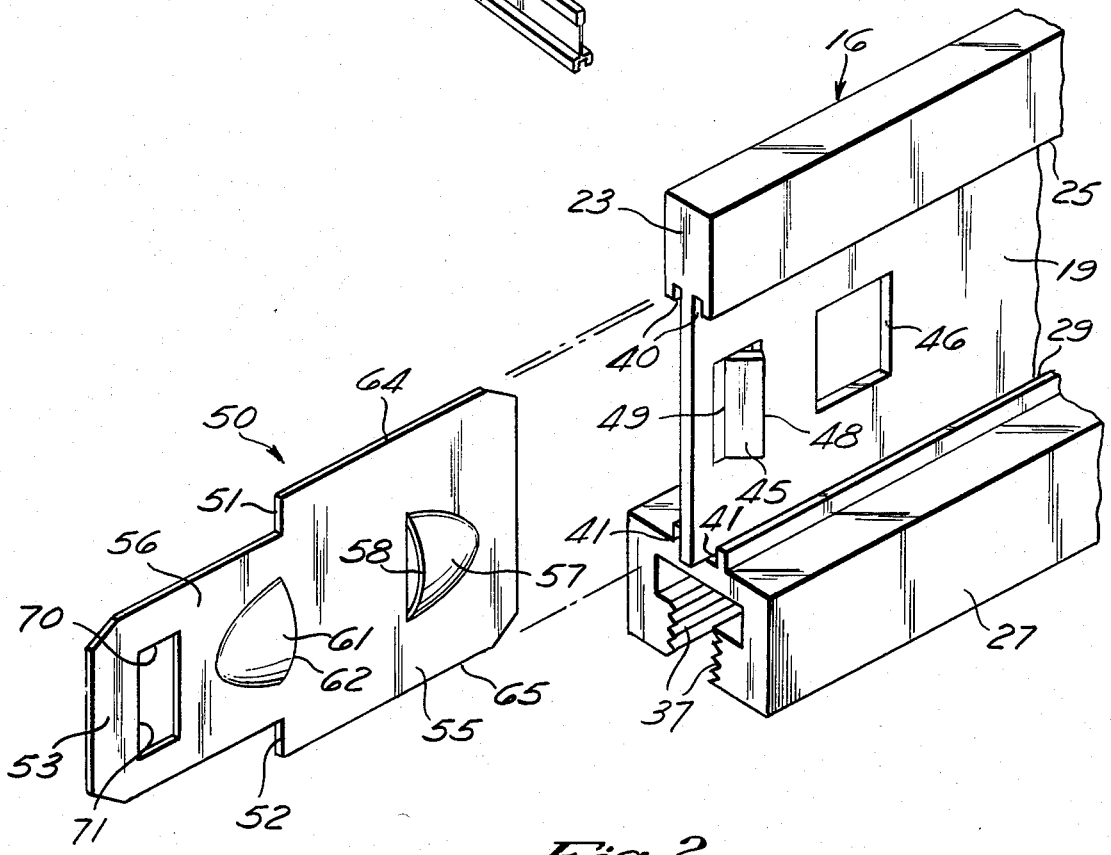
FIG. 2 is a partial perspective view showing a tongue plate and an associated portion of a cross runner.

In FIG. 2, a tongue plate 50 is shown as aligned for mounting onto the end of a cross runner 16. A pair of vertical offsets 51, 52 subdivide the tongue plate 50 into a rectangular base portion 55 and a tongue portion 56, having a tip 53. A first dimple or detent 57 is formed in the base portion 55, by cutting and laterally deforming the tongue plate material to create an edge 58 which: (i) projects laterally from the side of the tongue plate 50; and (ii) is oriented to face in the same direction as tip 53. The remaining portions of the dimple 57, however, blend from the plane of the tongue plate 50 and thus provide a smooth transition from the tongue plate 50 to the laterally projecting edge 58. The first dimple is positioned in the base portion 55 along the central longitudinal axis of the tongue plate 50.

The tongue plate 50 is also provided with a second dimple or detent 61. The second dimple 61 is formed in the tongue portion 56 in an analogous manner as to the formation of the first dimple 57. An edge 62 is obtained which: (i) projects laterally from the side of the tongue plate 50 in the same lateral direction as the edge 58; and (ii) is oriented to face in the opposite direction as the edge 58, away from the tip 53. The second dimple 61 is positioned in the tongue portion 56 along the central longitudinal axis of the tongue plate 60, with the edge 62 located on an imaginary line formed by vertical offsets 51, 52.

Finally, an aperture 70 having a forward edge 71 is provided in the tongue portion 56 of the tongue plate 50. The aperture is more or less rectangular in configuration, having its long axis of symmetry perpendicular to and symmetric about the central longitudinal axis of the tongue plate 50. The aperture 70 is located on the tongue portion 56 between the second dimple 61 and the tip 53.

As can best be seen in FIG. 2, slots or grooves 40, 41 are provided in the box portion 23 and flange portion 27, respectively, adjacent to the upper edge 25 and lower edge 29, respectively, of the cross runner 16. The grooves 40, 41 run the length of the cross runner 16, and are dimensioned such as to slidably receive the base portion 55 the tongue plate 50 when placed laterally adjacent thereto (longitudinal axes parallel).

Also illustrated in FIG. 2 are tabs 45 and aperture 46, spaced along the central longitudinal axis of the web 19 for the cross runner 16. The aperture 46 is rectangular in configuration, with its long axis of symmetry perpendicular to the central longitudinal axis of the web 19. The tab 45 is located between and in close proximity to the aperture 46 and the end of the cross runner 16. The tab 45 is more or less trapezoidal in shape, and is formed by lancing the web 19 at the end of the cross runner 16 and bending the lanced portion laterally therefrom, in a clockwise manner, so that it projects from the side of the web 19, forming an edge 48 and base 49. The edge 48 faces towards the aperture 46. The base 49 of the tab 45 is located approximately on an imaginary line passing through the terminus of the recessed flange 27 (see FIG. 6). As previously indicated, the tongue plate 50 is slidably mounted on the cross runner 16. Upper and lower edges 64, 65, respectively, of the base portion 55 are received by the grooves 40, 41, respectively, of cross runner 16. As there are two upper and lower grooves 40, 41, the grooves that receive plate 50 are those located on the side of cross runner 16 opposite to the side from which tab 45 laterally projects.

Figure 7:
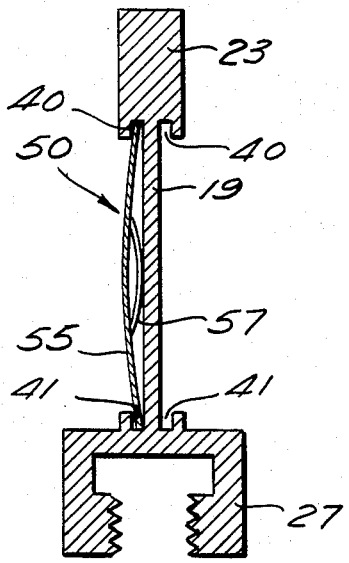
FIG. 7 is a side elevational view in cross section showing a tongue plate which has been partially received by a cross runner, a dimple formed in the tongue plate causing the plate to elastically deform outwardly from the cross runner.

Upon receipt of the edges 64, 65 by the grooves 40, 41, the mounting operation continues with the tongue plate 50 being inserted further on the cross runner 16, sliding in grooves 40, 41. As the grooves 40, 41 maintain the tongue plate 50 in close proximity to the surface of the web 19, continued insertion of the tongue plate 50 will cause the raised portions of the first dimple 57 to press against the web 19, biasing the tongue plate 50 away from web 19. FIG. 7 illustrates this intermediate position, with the more rigid first dimple 57 causing the tongue plate 50 to elastically deform in a convex manner from the web 19. This deformation will continue until the first dimple 57 reaches the aperture 46, which is of a size slightly smaller than that required to freely receive the first dimple 57. Upon reaching the aperture 46, the first dimple 57 will spring into the aperture 46.

The slight difference in size between the aperture 46 and the first dimple 57 creates a biasing force which tends to retain the first dimple 57 within the aperture 46. Once in place, the edge 58 of the first dimple 57 abuts the forward edge of the aperture 46, preventing the tongue plate 50 from being backed off, i.e., removed.

Figure 5:
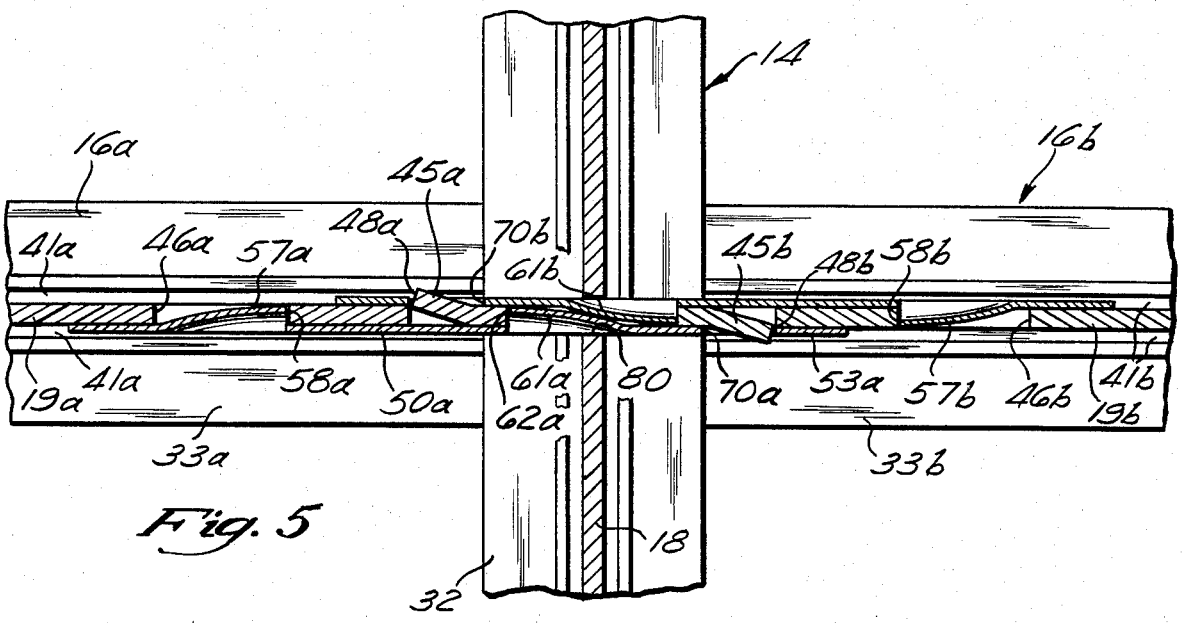
FIG. 5 is a fragmentary plan view in section taken substantially along the line 5—5 of FIG. 4, showing a connection between two cross runners and a main runner, according to the present invention.

Further forward sliding of the cross runner 16 is prevented, both by the first dimple 57 being within the aperture 46, and by the edge 62 of the second dimple 61 abutting the end of the web 19, as shown by FIGS. 5 and 6. FIG. 3 best shows the tongue plate 50 as mounted on the cross runner 16, (cross runners 16*a*, 16*b*).

As shown in FIG. 3, the tongue plates 50*a*, 50*b*, have been mounted on the cross runners 16*a*, 16*b*. A vertical slot 80 is formed in the webbed portion 18 of the main runner 14. The slot 80 receives the tongue portion 56*a* of the tongue plate 50*a* mounted on the cross runner 16*a*, and the tongue portion 56*b* of the tongue plate 50*b* mounted on the cross runner 16*b*. The slot 80 is only slightly larger in height than the tongue portions 56, thus avoiding sloppiness in fit.

The tongue portions 56*a*, 56*b* are inserted into the slot 80 from opposite directions, as shown in FIG. 3, and interlock in a manner which permits the cross runner 16*a*, 16*b* to lie in the same vertical plane, generally perpendicular to the vertical plane of the main runner 14. The slot 80 is rectangular in shape and does not include any projections, protrusions, or irregularities which might interfere with or be damaged by the insertion of the cross runner 16*a*, 16*b* therein.

Upon alignment with slot 80, insertion of the tongue portions 56*a*, 56*b* proceeds as a straight-in movement, with the tongue portions 56 positioned such that the second dimples 61 project laterally towards one another during insertion. Thus, as viewed from the perspective of FIGS. 3 and 4, the tongue portions 56*a*, 56*b* are inserted through the slot 80 to the right of one another.

This relationship is necessary to ensure proper interlocking.

Figure 4:
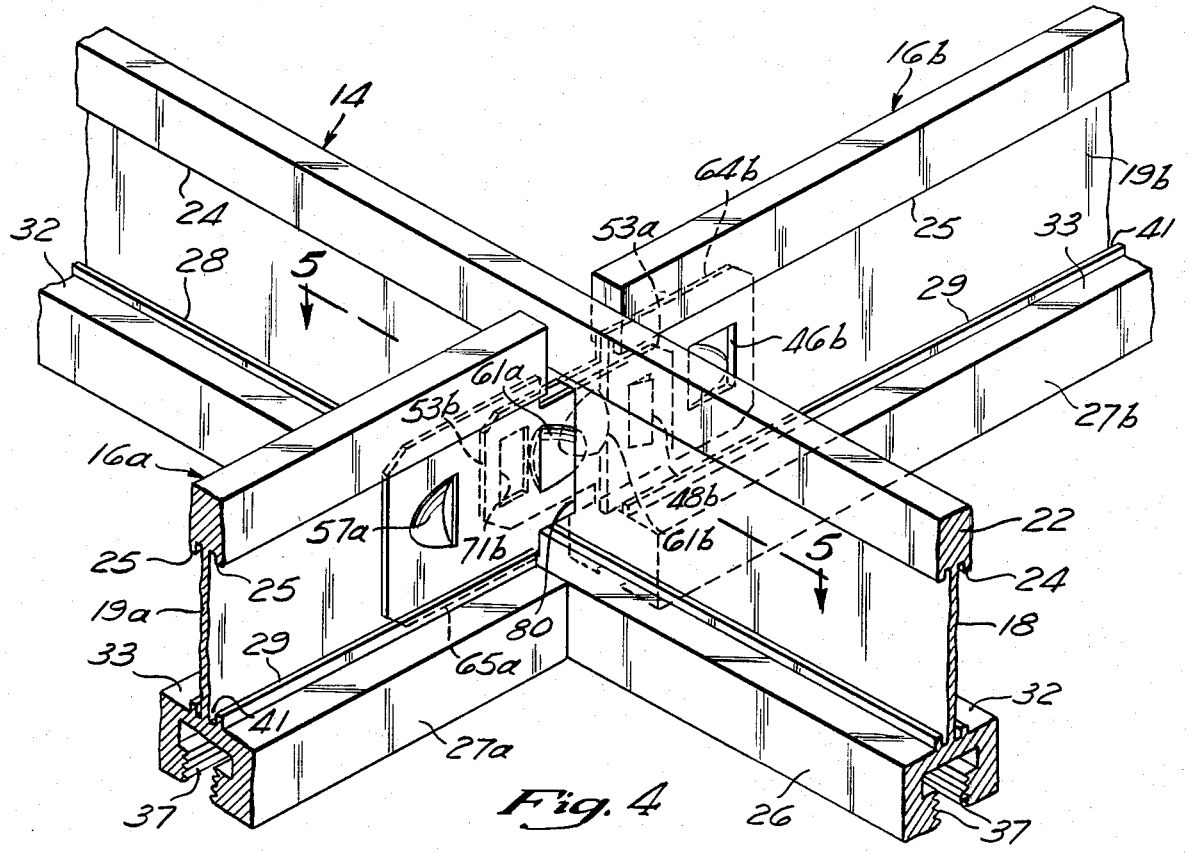
FIG. 4 is a partial perspective view showing a connection between two cross runners and a main runner, according to the present invention.

Referring to FIGS. 4, 5 and 6, as tongue portions 56*a*, 56*b* are inserted through the slot 80, one surface of the tongue plate 50*a* will slide along or be closely adjacent to the corresponding surface of the tongue plate 50*b*, until the tip 53*a* makes contact with the web 19*b* and the tip 53*b* reaches the web 19*a*. Upon continued insertion, the tongue portions 56*a*, 56*b* will slide along the surface of the webs 19*b*, 19*a*, respectively, until the tabs 45 are encountered. When the tip 53*a* makes contact with the tab 45*b* (it being understood that the interactions of the tip 53*b* and the tab 45*a* are analogous), continued insertion causes the tongue portion 56*a* to cam laterally outward until the edge 71*a* of the aperture 70*a* clears the edge 48*b* of the tab 45*b*, at which time the tongue 56*a* snaps back against the web 19*b* so that the tab 45*b* protrudes through the aperture 70*a*.

The inter-engagement between the tab 45*b* and the aperture 70*a* prevents the retracted movement of the tongue portion 56*a* through the slot 80, while an analogous interengagement between the tab 45*a* and the aperture 70*b* prevents the tongue portion 56*b* from being pulled out of the slot 80. Further forward movement of the cross runners 16*a*, 16*b* is prevented by the abutment of lower flange portions 27*a*, 27*b* against the lower flange portion 26 of the main runner 14 (see FIG. 6).

As also shown in FIG. 6, the second dimples 61*a*, 61*b* are so positioned on the tongue portions 50*a*, 50*b*, that upon complete insertion, the dimples 61*a*, 61*b* lie adjacent one another in the slot 80. As the combined lateral width of both dimples 61*a*, 61*b* is greater than the lateral dimension of slot 80, an outward biasing force is exerted against the outside walls of the slot 80. Such a force acts so as to "fill" the slot 80 with the tongue portions 50*a*, 50*b* and thereby avoid vibration or sloppiness.

The structural interactions of the connection as completed might best be illustrated by briefly describing FIG. 5. The tongue plates 50*a*, 50*b* are shown received by the grooves 41*a*, 41*b* and mounted on the webs 19*a*, 19*b* with the first dimples 57*a*, 57*b* snapped into the apertures 46*a*, 46*b* respectively. The tongue portions 56*a*, 56*b* project through the slot 80, with the tabs 45*a*, 45*b* protruding through the apertures 70*b*, 70*a*, respectively. The interaction between the second dimples 61*a*, 61*b* is shown within the slot 80. The end result is a connection utilizing separate connector means but requiring no tools or mechanical bending operations conducted on the main or cross runners.

While I have disclosed an exemplary structure to illustrate the principles of the present invention, it should be understood that I wish to embody within the scope of the patent warranted hereon, all such modifications reasonably and properly come within the scope of my contribution to the art.

I claim as my invention:

1. A suspended ceiling grid system, comprising:

a plurality of main runners for forming plural longitudinal beams in spaced, parallel relationship, each of said main runners comprising a web, having upper and lower edges, and one or more slots therethrough;

a first and a second cross runner for forming an interconnection with a main runner, each cross runner fitting between a pair of adjacent longitudinal beams and each cross runner comprising a web, having upper and lower edges;

first means detachably mounted on said first cross runner for engaging said second cross runner;

second means detachably mounted on said second cross runner for engaging said first cross runner; and said first and second means directly interlocking said cross runners when said first and second means are inserted into said main runner slot from opposite directions to prevent movement of said cross runners away from each other independent of said main runner web, wherein said first and second means each comprise:

a flat plate having a base portion and a tongue portion;

a first dimple formed in said base portion for detachably mounting in an aperture formed on the end of a cross runner;

a second dimple and an aperture formed on said tongue portion; and a tab formed on the end of a cross runner, said tongue aperture receiving said tab when the tongue portions are inserted into said main runner slot from opposite directions.

2. A suspended ceiling system as described in claim 1, wherein said second dimples of said tongue portions abut one another within the main runner slot whereby vibrations and sloppiness of fit are avoided.

3. A suspended ceiling grid system, comprising:

a plurality of main runners for forming plural longitudinal beams in spaced, parallel relationship, each of the main runners comprising: a web, having upper and lower edges, and a slot therethrough, and a support flange connected to the lower edge of the web, having a support surface extending substantially perpendicularly from the web;

a plurality of cross runners for interconnecting a pair of adjacent longitudinal beams, each of the cross runners comprising:

a web, having upper and lower edges, and connection means formed at each longitudinal end thereof, and a support flange connected to the lower edge of said web, having a support surface extending substantially perpendicularly from said web and, when the cross runner abuts said main runner, said cross runner support surface and said main runner support surface line in a substantially common plane throughout their length;

a plurality of connector means for connecting cross runners to main runners, having means for selective attachment to the connection means of two separate cross runners when said two cross runners are linearly aligned and abutting opposite sides of a main runner, the connector means sized to pass through the slot in said main runner, thus forming an interconnection between two cross runners, with a longitudinal beam located therebetween, wherein said connector means further comprise:

at least one flat plate having vertical off-sets defining a base portion and a tongue portion projecting therefrom, and said cross runner further comprising:

a pair of grooves formed in the support flange adjacent the web, and a box portion connected to the upper edge of the web, said box portion having a pair of grooves formed therein adjacent the web and corresponding to said grooves in the support flange, the grooves on each side of the web cooperating to slidably receive the base portion of the connector means and maintain said base portion in close relationship with the web.

4. A suspended ceiling grid system as described in claim 3, wherein the connection means for each end of the cross runners comprise:

a tab formed in said web between an aperture, also formed in said web, and the adjacent longitudinal end of the web; and wherein the means for selective attachment of the connector means comprises:

a first detent or dimple formed in the base portion and of a size corresponding to that of the aperture formed in the cross runner web, and said tongue portion having an aperture formed therein of a size corresponding to that of the tab, the flat connector plate, when mounted on the cross runner, is received by the grooves located adjacent the web, with the first dimple received by the aperture formed in said web, and the completed connection with a second cross runner has the tongue portion passing through the slot in the main runner with the aperture located thereon received by one of the tabs of the second cross runner.

5. A suspended ceiling grid system as described in claim 4, and further comprising:

a second detent or dimple formed in the tongue portion, wherein the second dimples of said tongue portions engage one another within the main runner slot when said tongue portions are inserted into said main runner slot from opposite directions.

6. In a suspended ceiling grid system, a connector means for connecting a first cross runner to a second cross runner through a main runner having a slot for receiving the connector means, said cross and main runner each comprising a support flange connected to the bottom edge of a web, said flanges each having a support surface projecting perpendicularly from their respective webs, the connector means comprising:

a first and second connector piece, each of which comprising:

a tongue portion, sized for insertion through the main runner slot and including means for interlockingly engaging said tongue portion with one of said cross runners, and a base portion having means for selectively engaging the other of said cross runners; and engaging means on said first and second cross runners for selectively engaging the base portion of one connector piece and the tongue portion of the other connector piece, wherein said means for interlockingly engaging said tongue portion comprise:

a second dimple, formed in the tongue portion, and said tongue portion having an aperture formed therein, located between said second dimple and the tip of said tongue portion;

wherein said engaging means on said first and second cross runners for selectively engaging the tongue portion comprises:

a tab formed on the cross runner and located between the end of said cross runner and the aperture formed on said cross runner located adjacent thereto, said tab of a size to receive the aperture formed on said tongue portion upon the insertion of said tongue portion through the main runner.

7. A suspended ceiling means as described in claim 6 wherein said second dimple is located on said tongue portion such that upon engagement of the tongue with the cross member, said second dimple lies partially within the slot in the main runner and in abutment with the second dimple of said other connector piece.

8. In a suspended ceiling grid system, a connector means for connecting a first cross runner to a second cross runner through a main runner having a slat for receiving the connector means, said connector means of the type consisting of a tongue portion sized for insertion through the main runner slot and a base portion sized for being slidably mounted on the end of a cross runner and having means for selectively engaging the cross runner, wherein the improvement comprises:

a laterally deformable base portion having a relatively rigid selective engaging means formed thereon, the base portion elastically deforming as the connector means is slidably received by the cross runner.

9. A suspended ceiling grid system, comprising:

a main runner comprising:

a web, having upper and lower edges and a slot therethrough, and a support flange, connected to the lower edge of said web;

first and second cross runners, interconnected through said slot, each of said cross runners comprising:

a web, having upper and lower parallel edges throughout its length, a support flange connected to and coextensive with the lower edge of said web; and first and second connector pieces extending from and connecting said first and second runners, each of said connector pieces comprising:

means interconnecting said first and second cross runners for preventing movement of said cross runners away from each other, and means engaging the side of said slot for preventing movement of said connector pieces within said slot;

wherein said interconnecting means comprise:

a first dimple formed in one end of said connecting piece and received by an aperture formed in the end of a cross runner, and an aperture formed in the other end of said connecting piece of size sufficient to receive a tab formed in the end of a cross runner ;

wherein said engaging means comprise:

a second dimple formed on said connecting piece and located between said first dimple and the aperture, such that said second dimple lies within the slot of said main runner when said first and second cross runners are connected; wherein said engaging means comprise a detent or dimple formed in the base portion, said dimple of a size corresponding to that of an aperture formed in the cross runner web.

* * * * *